US010475566B2

(12) United States Patent
Touzet et al.

(10) Patent No.: US 10,475,566 B2
(45) Date of Patent: Nov. 12, 2019

(54) ELECTROMAGNETIC INDUCTION DEVICE CONFIGURED AS A MULTIPLE MAGNETIC CIRCUIT

(71) Applicant: THALES, Courbevoie (FR)

(72) Inventors: Eric Touzet, Chatou (FR); Nicolas Potelle, Chatou (FR)

(73) Assignee: THALES, Courbevoie (FR)

( * ) Notice: Subject to any disclaimer, the term of this patent is extended or adjusted under 35 U.S.C. 154(b) by 78 days.

(21) Appl. No.: 15/546,653

(22) PCT Filed: Feb. 11, 2016

(86) PCT No.: PCT/EP2016/052926
§ 371 (c)(1),
(2) Date: Jul. 26, 2017

(87) PCT Pub. No.: WO2016/128520
PCT Pub. Date: Aug. 18, 2016

(65) Prior Publication Data

US 2018/0012694 A1 Jan. 11, 2018

(30) Foreign Application Priority Data

Feb. 13, 2015 (FR) ..... 15 00283

(51) Int. Cl.

| | |
|---|---|
| ***H01F 27/24*** | (2006.01) |
| ***H01F 27/245*** | (2006.01) |
| ***H01F 27/08*** | (2006.01) |
| ***H01F 27/28*** | (2006.01) |
| ***H01F 41/08*** | (2006.01) |
| ***H01F 41/061*** | (2016.01) |
| ***H01F 27/29*** | (2006.01) |
| *H01F 27/26* | (2006.01) |

(52) U.S. Cl.
CPC ..... *H01F 27/245* (2013.01); *H01F 27/08* (2013.01); *H01F 27/2847* (2013.01); *H01F 27/29* (2013.01); *H01F 41/061* (2016.01); *H01F 41/08* (2013.01); *H01F 27/266* (2013.01); *H01F 2027/2857* (2013.01)

(58) Field of Classification Search
CPC ..... H01F 2027/2857; H01F 41/061
USPC ..... 336/216
See application file for complete search history.

(56) References Cited

U.S. PATENT DOCUMENTS 3,894,270 A * 7/1975 Manske ..... H01F 27/2866 315/379
4,060,783 A 11/1977 Harnden
4,504,813 A * 3/1985 Strang ..... H01F 27/25 336/213
5,157,893 A 10/1992 Benson et al.
(Continued)

FOREIGN PATENT DOCUMENTS

CN 102 945 734 A 2/2013
FR 2 939 559 A1 6/2010

*Primary Examiner* — Ronald Hinson
(74) *Attorney, Agent, or Firm* — Baker & Hostetler LLP

(57) ABSTRACT

An electromagnetic induction device comprises a closed magnetic circuit, without air gap, of which at least one first part is substantially rectilinear and surrounded by a sleeve, the sleeve being surrounded by an electrical conductor which comprises at least one metal sheet electrically insulated on at least one of its faces, wherein at least the first part of the magnetic circuit has a section of circular form.

10 Claims, 3 Drawing Sheets

(56) References Cited

U.S. PATENT DOCUMENTS

| | | | | |
|---|---|---|---|---|
| 5,210,513 | A * | 5/1993 | Khan | H01F 27/22 336/233 |
| 5,337,028 | A * | 8/1994 | White | H03H 7/0123 333/181 |
| 5,640,752 | A * | 6/1997 | Steiner | H01F 41/0233 29/564.1 |
| 6,087,916 | A * | 7/2000 | Kutkut | H01F 27/22 336/195 |
| 7,205,875 | B2 * | 4/2007 | Oughton, Jr. | H01F 27/085 336/58 |
| 7,474,187 | B1 * | 1/2009 | Huang | H01F 27/027 336/65 |
| 2014/0002229 | A1 | 1/2014 | Xu et al. | |

* cited by examiner

ELECTROMAGNETIC INDUCTION DEVICE CONFIGURED AS A MULTIPLE MAGNETIC CIRCUIT

CROSS-REFERENCE TO RELATED APPLICATIONS

This application is a National Stage of International patent application PCT/EP2016/052926, filed on Feb. 11, 2016, which claims priority to foreign French patent application No. FR 1500283, filed on Feb. 13, 2015, the disclosures of which are incorporated by reference in their entirety.

FIELD OF THE INVENTION

Background

The present invention relates to the field of electromagnetic inductors and electrical transformers. This type of device is for example used to produce a filter at the output of an alternating/direct electrical current converter. These inductors make it possible to reduce the residual current and/or voltage variations at the output of such a converter. This type of electromagnetic inductor, called coil, can also be implemented to produce a transformer. In this case, it is necessary to couple several coils wound around one and the same magnetic circuit.

In the aeronautical field, the weight and the noise of the embedded components are important parameters for which reductions are sought. To this end, it is possible to use electrical conductors made of aluminum, lighter than copper, for a use of the electrical component at a given power. The ductility of aluminum is much lower than that of copper. Consequently, aluminum in sheet form is often used, that is wound to produce coils.

The coils are wound around closed magnetic circuits to best guide the magnetic flux. Magnetic circuits produced in two parts are commonly used. The coil or coils are produced outside of the magnetic circuit, then placed therein. Once this operation is completed, the two parts of the magnetic circuit are assembled to close the circuit. The junction between the two parts forms an air gap. It is difficult to make the two surfaces forming the air gap strictly parallel: there remains a low deviation between the two parts that is difficult to eliminate. The surfaces of the two parts intended to come into contact can be ground in order to improve the surface condition at the junction. It is also possible to band the magnetic circuit by means of a strip surrounding it to close it. The banding force contributes to further reducing the air gap.

Nevertheless, the electrical current circulating in the coils can generate mechanical vibrations in the device. These vibrations tend to separate the two parts of the magnetic circuit to reform an air gap. The vibrations can also tend to loosen the mechanical securing of the different parts of the magnetic circuit, which tends to allow the amplitude of the vibrations to increase throughout the life of the coil. At the same time, the induction device heats up during its use. The temperature difference of the induction device between use and rest can lead to an expansion of the magnetic circuit and the appearance of a deviation in the air gap.

Moreover, the vibrations described previously tend also to generate noise which can be a nuisance. The constructors, for example in aeronautics, demand increasingly lower sound nuisance levels.

To mitigate this problem, there are electromagnetic induction devices and transformers in which the magnetic circuit does not have an air gap. The electrically conductive coil must be wound around the magnetic circuit: a device for this winding is described in the patent FR 2939559. This device uses a sleeve, also called duct, of circular internal section, assembled from two parts around the magnetic circuit. The electrical conductor is first of all attached to this sleeve. A driving means then rotates this sleeve, via a sleeve engaging means. The sheet or sheets of electrical conductor are then wound around the sleeve.

Another known technical problem with induction devices lies in the occurrence of eddy currents in the magnetic circuit, leading to a loss of energy due to the electrical resistance of the magnetic material, if the material is an electrical conductor. This problem is conventionally mitigated by the production of a layered laminated magnetic circuit: flat plates of magnetic material, electrically insulated from one another by an electrically insulating material, such as lacquer or certain types of glue, are superposed one on top of the other. This super positioning can also be obtained by winding a plate. Each layer of the winding is then separated by an electrically insulating material.

The magnetic material used in the magnetic circuit is often a soft magnetic material, to avoid the losses of energy by hysteresis upon the imposition of variable magnetic fluxes. The circuit obtained makes it possible to limit the occurrence of the eddy currents, but the section of the magnetic circuit obtained, by using this production method, is rectangular.

The difference in form between the circular section of the sleeve and the rectangular section of the magnetic circuit limits the efficiency of the energy coupling between the coil and the magnetic circuit and leads to losses in the use of the transformer.

Another limitation of the device is linked to the losses by Joules' effect. They can reach high temperatures (typically above 100° C.) on the device and thus limit its use. Different cooling means are generally used to reduce the temperature of the electromagnetic induction devices: by liquid contact or by solid contact with a cold reservoir.

The invention aims to overcome at least one of the abovementioned drawbacks of the prior art.

SUMMARY OF THE INVENTION

One object of the invention making it possible to achieve this aim is an electromagnetic induction device comprising a closed magnetic circuit, without air gap, of which at least one first part is substantially rectilinear and surrounded by a sleeve, said sleeve being surrounded by an electrical conductor which comprises at least one metal sheet electrically insulated on at least one of its faces, characterized in that at least said or each said first part of said magnetic circuit has a section of circular form, and in that said magnetic circuit is laminated with several layers of magnetic material separated by an electrical insulator, and that at least one said sleeve comprises an inner face of which the form of a section is circular and closely fits the form of said magnetic circuit, and an outer face comprising curved parts and planar parts.

Advantageously, said magnetic circuit comprises at least one second part which has at least one planar surface.

Advantageously, said electromagnetic induction device comprises a local heat exchanger in contact with said magnetic circuit outside of said first part or parts.

Advantageously, said local heat exchanger comprises at least one surface closely fitting the form of said magnetic circuit and at least one planar surface.

Advantageously, a section of said magnetic circuit is of circular form along the contact with at least one said local heat exchanger.

Advantageously, several surfaces chosen from at least one said planar surface of said magnetic circuit and at least one said planar surface of said local heat exchanger or exchangers, are coplanar and adapted to be placed in contact with at least one planar heat exchanger.

Advantageously, said magnetic circuit comprises at least one sheet of magnetic material electrically insulated on at least one of its faces and wound over at least one element chosen from at least one other said sheet of magnetic material and itself.

Advantageously, each said sleeve comprises several parts adapted to cooperate to surround said magnetic circuit.

Advantageously, at least one said sleeve comprises at least one engaging means adapted to transmit a drive to allow the rotation of each said sleeve about each said longitudinal axis of each said first part, in order to wind and order at least one said electrical conductor in sheet form around each said sleeve.

Advantageously, said electromagnetic induction device comprises two planar electrical conductors in electrical contact with one said electrical conductor and arranged so as to form the terminals of said electrical conductor.

BRIEF DESCRIPTION OF THE DRAWINGS

The invention will be better understood and other advantages, details and features thereof will become apparent on reading the following explanatory description, given by way of example with reference to the attached drawings in which.

DETAILED DESCRIPTION

The following description presents a number of exemplary embodiments of the device of the invention: these examples are nonlimiting on the scope of the invention. These exemplary embodiments show both the essential features of the invention and additional features associated with the embodiments considered. For clarity, the same elements will bear the same references in the different figures.

Figure 1:
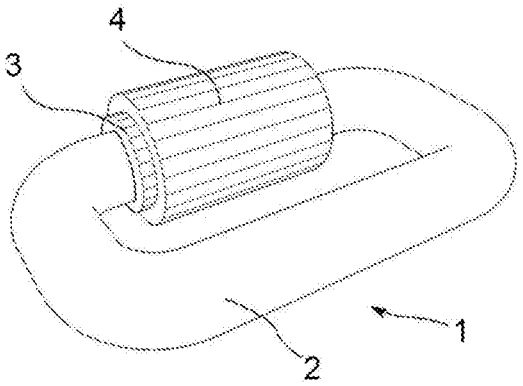
FIG. 1 is a perspective schematic view of an electromagnetic induction device.

FIG. 1 presents a perspective schematic view of an electromagnetic conduction device 1. The magnetic circuit 2 is closed and without air gap. In this particular embodiment of the invention, it has a section of circular form along all of the circuit 2. It is surrounded by a sleeve 3 over a rectilinear part of the magnetic circuit, called first part 11. The sleeve 3, in a particular embodiment of the invention, can be produced in an insulating material, for example by the compact vacuum insulation method (U.S. Pat. No. 5,157,893 A). The magnetic circuit 2 has at least one part that is rectilinear, or at the very least, that can be likened to a rectilinear part given the length of the sleeve 3.

An electrical conductor 4 in sheet form is wound around the sleeve 3. In a particular embodiment of the invention, the sheet can be made of aluminum. The sheet must be electrically insulated on at least one of its faces to keep the properties of an electromagnetic coil. In a particular embodiment of the invention, oxidation of the surface of the electrical conductor 4, lacquer or glue, or a mixture of lacquer and glue are used to electrically insulate layerings of the sheet of electrical conductor 4.

Figure 2:
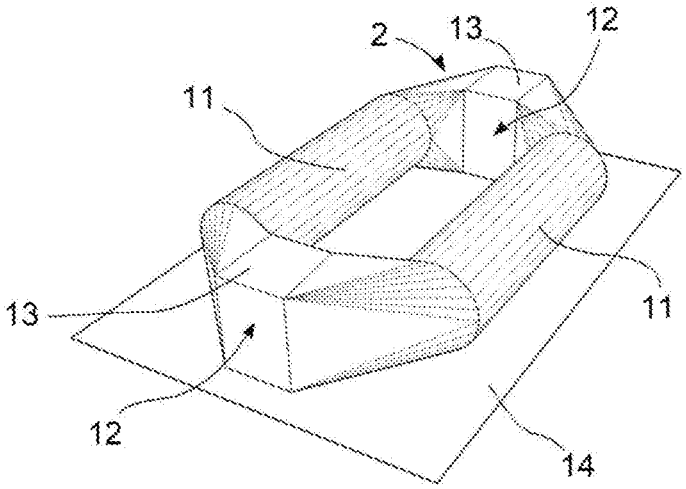
FIG. 2 is a perspective schematic view of a magnetic circuit and of a planar heat exchanger.

FIG. 2 presents a perspective schematic view of a magnetic circuit 2 and of a planar heat exchanger 14. The magnetic circuit 2 represented in this particular embodiment of the invention has several distinct parts: first parts 11, defined previously and parts each having at least one planar surface of said magnetic circuit 13, called second parts 12. In a particular embodiment of the invention, some of these planar surfaces can be coplanar and adapted to be placed in contact with a planar heat exchanger 14. This configuration makes it possible to control or limit the temperature of the device during use at high power. In the example of FIG. 2, the two planar surfaces 13 are coplanar and adapted to be placed in contact with a planar heat exchanger 14. For clarity of the representation, the planar heat exchanger 14 is placed in contact with two other planar surfaces 13 that are coplanar and not referenced by the figure.

Figure 3:
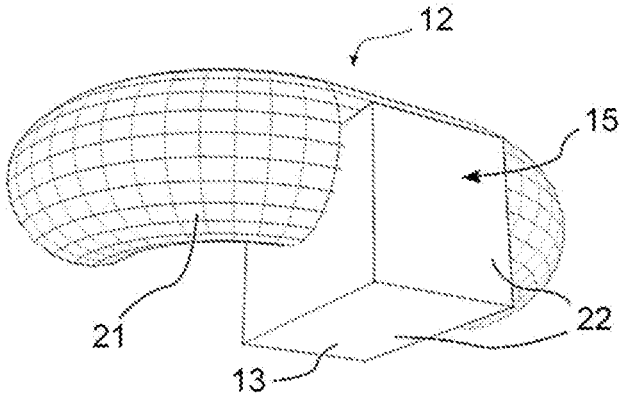
FIG. 3 is a perspective schematic view of a part of the magnetic circuit and of a local heat exchanger.

FIG. 3 is a perspective schematic view of a part of the magnetic circuit 2 and of a local heat exchanger 15, also called cradle. The local heat exchanger 15 is in contact with a portion of the magnetic circuit 2 other than a first part 11. The local heat exchanger 15 has a face which closely fits the form of the magnetic circuit 2 to maximize the contact surface and thus favor the heat transfer, for a given form of magnetic circuit 2. Furthermore, the local heat exchanger 15 has at least one planar surface 22. In FIG. 3, the local heat exchanger 15 has several planar surfaces 22, one of which coincides with a planar surface 13. In the particular embodiment of the invention represented in FIG. 3, the portion of magnetic circuit 2 has a section of circular form along the contact with the local heat exchanger 15.

Figure 4A:
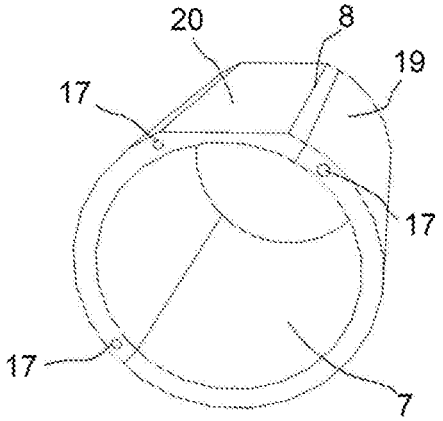
FIGS. 4A and 4B are perspective schematic views on the one hand of a sleeve and on the other hand of a part of a sleeve.
Figure 4B:
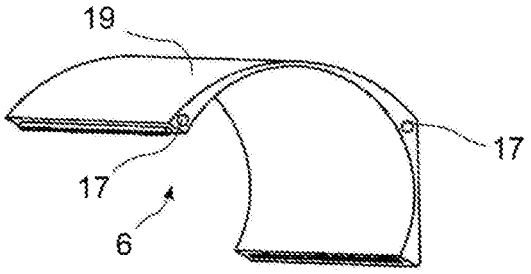

FIG. 4A presents a perspective schematic view of a sleeve 3. FIG. 4B presents a part of a sleeve 6. In this particular embodiment of the invention, the sleeve 3 presented is made up of two parts of sleeve 6. A part of sleeve 6 alone cannot surround the magnetic circuit 2. On the other hand, it is possible to securely assemble different parts of sleeves 6 in cooperation to surround the magnetic circuit 2 and form a sleeve 3. Such cooperation is presented in FIGS. 4A and 4B.

FIGS. 4A and 4B also present engaging means 17 of the sleeves 3, which, depending on the embodiments, can be holes, notches, protuberances, tenons or mortices. These engaging means 17 are useful during the production of the device 1. Once a conductive metal sheet is attached outside the sleeve 3, a rod can be pressed into each engaging means 17 then transmit a motor torque allowing a rotation of the sleeve 3 about the longitudinal axis of a first part 11 of magnetic circuit 2. This rotation makes it possible to wind the metal sheet around the sleeve 3 and thus form a winding of electrical conductor 4 around the magnetic circuit 2.

FIGS. 4A and 4B present a sleeve whose inner face 7 has a circular section. This attribute is essential to be able to perform a rotation of the sleeve 3 around the magnetic circuit 2 on the longitudinal axis of a first part 11, during the production of the device. On the other hand, the outer face 8, that is to say the lateral face of the sleeve, comprises a curved part 19 and a planar part 20. It is also possible to define the outer face 8 as an axial face: this is a surface which can be defined by a set of straight lines parallel to the main axis of the sleeve. On the outer face 8, the production of the device requires the absence of any excessively pronounced angle which could induce the breaking or the tearing of the sheet of electrical conductor 4 during the winding around the sleeve 3. The alternation presented in FIGS. 4A and 4B between curved part 19 and planar part 20 makes it possible to mitigate this problem while keeping a planar part 20, useful to the electrical connections of the device 1. The planar part 8 of the sleeve brings about, upon a winding, the arrangement of a planar part of a metal sheet surrounding the sleeve 3, located on the planar part 8. A planar contact between the metalized sheet and another element can thus be produced, allowing for example for a transfer of heat from the electromagnetic induction device to this element. This feature can make it possible to cool the electromagnetic induction device.

Figure 5:
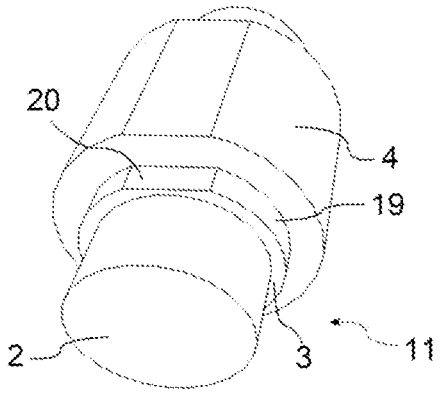
FIG. 5 is a perspective schematic view of a part of the magnetic circuit, of a sleeve and of an electrical conductor.

FIG. 5 is a perspective schematic view of a part of the magnetic circuit 2, of a sleeve 3 and of an electrical conductor 4. It presents the electrical conductor 4 in a sheet wound around the sleeve 3, itself assembled around a first part 11 of magnetic circuit 2 of circular section. The presence of a curved part 19 and of a planar part 20 on the outer face of the sleeve 8 is reflected in the form of the winding: FIG. 5 presents a winding of electrical conductor 4 whose outer part also has a curved part and a planar part. This attribute too is also useful to the electrical connections of the device 1.

Figure 6A:
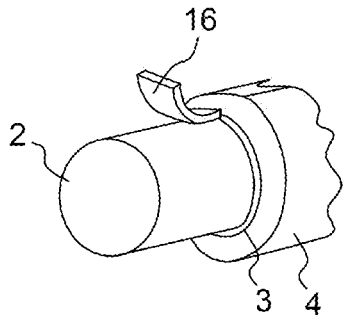
FIGS. 6A and 6B are perspective schematic views of details of a part of the electromagnetic induction device.
Figure 6B:
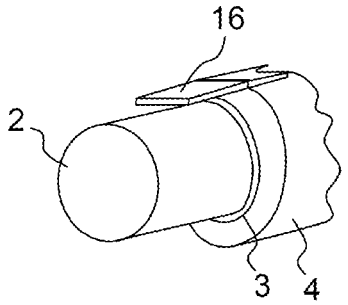

FIGS. 6A and 6B are perspective schematic views of details of a first part 11 of the electromagnetic induction device 1. In a particular embodiment of the invention, two planar electrical conductors 16 are in mechanical and electrical contact with the electrical conductor 4 wound around the duct. These two planar electrical conductors 16 are arranged in such a way as to form the terminals of the electrical conductor 4. In FIG. 6A, the planar electrical conductor 16 is in contact with the electrical conductor 4 at the start of the winding. In FIG. 6B, the planar electrical conductor 16 is in contact with the electrical conductor 4 at the end of the winding.

In this particular embodiment of the invention, the planar electrical conductors 16 can be placed on the planar part 20 of the outer face 8 of the sleeve 3, and/or on the corresponding planar parts of the winding of electrical conductor 4. This feature makes it possible to be able to fold the planar electrical conductors 16. The folding of the conductors makes it possible to simplify the external electrical connection of the device 1.

Figure 7A:
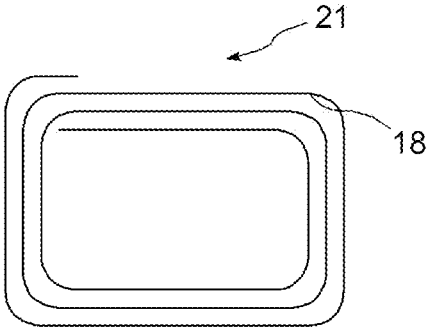
FIGS. 7A and 7B are plan schematic views of two windings of magnetic material.
Figure 7B:
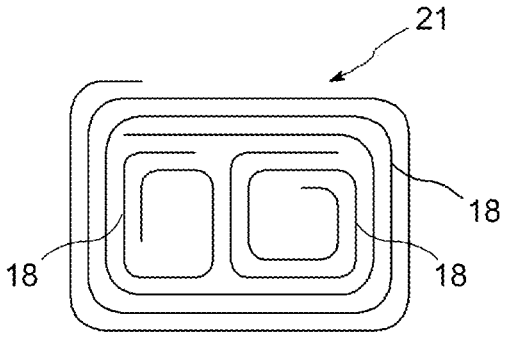

FIGS. 7A and 7B are plan schematic views of two windings of magnetic material 21. FIG. 7A describes a simple winding 21 of magnetic material: a single sheet of magnetic material 18 is wound on itself. This sheet 18 is covered on at least one of its faces by an electrical insulation. In particular embodiments of the invention, this insulation can be lacquer, or glue, or both.

This configuration provides the device with two distinct advantages. On the one hand, the magnetic circuit 2 formed by the simple winding 21 forms a succession of layers between magnetic material and electrical insulation. This configuration makes it possible to avoid the appearance of eddy currents by layering the magnetic circuit 2. These currents, when they exist, lead to energy losses linked to the electrical resistivity of the magnetic material. Also, this type of winding makes it possible to create a magnetic circuit of round section. In effect, starting from a sheet of magnetic material 18 of a variable width, the width of this sheet 18 can, for a fixed point of the magnetic circuit 2 and on each turn of the winding, increase or decrease substantially. This width is not visible in FIGS. 7A and 7B because the schematic representation is a plan view. Consequently, by starting from a sheet whose overall form is a rhomboid, it is possible to produce a magnetic circuit 2 whose section is circular. With this method, the greater the number of turns in the winding 21, the more the section can exactly approximate a circle. In the interests of clarity of the explanation, there are few windings 21 in FIGS. 7A and 7B. In a particular embodiment of the invention, the number of windings can be between 20 and 600.

FIG. 7B presents a winding 21 of several sheets of magnetic material 18 to produce the magnetic circuit 2. A first sheet of magnetic material 18 is wound around two sheets of magnetic material 18, wound on themselves. This configuration makes it possible to multiply the branches of the magnetic circuit 2 in the case of applications such as voltage ratio selection in a transformer. In this case, a winding 21 can be produced by several sheets of magnetic material 18 with the width increasing for each of the sheets 18.

The invention claimed is:

1. An electromagnetic induction device comprising a closed magnetic circuit, without air gap, of which at least one first part extends longitudinally along a longitudinal axis, the longitudinal axis being substantially rectilinear, the closed magnetic circuit being surrounded by a sleeve, said sleeve being surrounded by an electrical conductor which comprises at least one metal sheet electrically insulated on at least one of its faces, wherein:

said at least one first part of said magnetic circuit has a section of circular form, said magnetic circuit is layered by several layers of magnetic material separated by an electrical insulation, said sleeve comprises an inner face comprising a circular section closely fitting the form of said magnetic circuit, and an outer face comprising curved parts and planar parts, and said sleeve comprises a plurality of parts adapted to cooperate to surround said magnetic circuit.

2. The electromagnetic induction device as claimed in claim 1, wherein said magnetic circuit comprises at least one second part which has at least one planar surface.

3. The electromagnetic induction device as claimed in claim 1, wherein said magnetic circuit comprises at least one sheet of magnetic material electrically insulated on at least one of its faces and wound over at least one element chosen from at least one other said sheet of magnetic material and itself.

4. The electromagnetic induction device as claimed in claim 1, said sleeve comprises at least one engaging means adapted to transmit a drive to allow the rotation of said sleeve about said longitudinal axis of said at least one first part, in order to wind and order at least one said electrical conductor in sheet form around said sleeve.

5. The electromagnetic induction device as claimed in claim 1, comprising two planar electrical conductors in electrical contact with one said electrical conductor and arranged so as to form the terminals of said electrical conductor.

6. The electromagnetic induction device as claimed in claim 1, wherein said sleeve comprises a main axis, an inner face of which the form of a section is circular and closely fits the form of said magnetic circuit, and an outer face defined by a set of straight lines parallel to said main axis, comprising said curved parts and said planar parts.

7. The electromagnetic induction device as claimed in claim 1, comprising a local heat exchanger in contact with said magnetic circuit outside of said at least one first part.

8. The electromagnetic induction device as claimed in claim 7, wherein said local heat exchanger comprises at least one surface closely fitting the form of said magnetic circuit and at least one planar surface.

9. The electromagnetic induction device as claimed in claim 8, wherein a section of said magnetic circuit is of circular form along the contact with said local heat exchanger.

10. The electromagnetic induction device as claimed in claim 7, wherein several surfaces chosen from at least one said planar surface of said magnetic circuit and at least one said planar surface of said local heat exchanger is coplanar and adapted to be placed in contact with at least one planar heat exchanger.

* * * * *